US010227948B2

(12) United States Patent
Menotti et al.

(10) Patent No.: US 10,227,948 B2
(45) Date of Patent: Mar. 12, 2019

(54) PISTON FOR AN INTERNAL COMBUSTION ENGINE

(71) Applicant: MAHLE International GmbH, Stuttgart (DE)

(72) Inventors: Fabio Menotti, Canton, MI (US); Ioan Stefan, Farmington Hills, MI (US); Dieter Gabriel, Highland, MI (US); Ralph Klein, Plymouth, MI (US); Luiz Perrone, Ann Arbor, MI (US); Michael Lapp, Farmington Hills, MI (US); Joachim Wagenblast, Bloomfield Hills, MI (US)

(73) Assignee: MAHLE International GmbH, Stuttgart (DE)

( * ) Notice: Subject to any disclaimer, the term of this patent is extended or adjusted under 35 U.S.C. 154(b) by 67 days.

(21) Appl. No.: 14/973,864

(22) Filed: Dec. 18, 2015

(65) Prior Publication Data

US 2017/0175671 A1 Jun. 22, 2017

(51) Int. Cl.

| | |
|---|---|
| ***F01P 1/04*** | (2006.01) |
| ***F02F 3/22*** | (2006.01) |
| ***F02F 3/00*** | (2006.01) |

(52) U.S. Cl.

CPC ..... *F02F 3/225* (2013.01); *F02F 3/003* (2013.01); *F02F 3/22* (2013.01); *F02F 2003/0061* (2013.01)

(58) Field of Classification Search

USPC ..... 123/41.35

See application file for complete search history.

(56) References Cited

U.S. PATENT DOCUMENTS

| | | | | |
|---|---|---|---|---|
| 5,730,090 | A | 3/1998 | Kling et al. | |
| 6,032,619 | A * | 3/2000 | Zhu | F02F 3/003 123/41.35 |
| 6,701,875 | B2 | 3/2004 | Weng et al. | |
| 6,722,263 | B2 | 4/2004 | Keller et al. | |
| 7,051,684 | B2 | 5/2006 | Bauer | |
| 7,748,361 | B2 | 7/2010 | Linz et al. | |
| D737,861 | S | 9/2015 | He et al. | |

(Continued)

FOREIGN PATENT DOCUMENTS

| | | |
|---|---|---|
| EP | 1 063 409 A2 | 12/2000 |
| EP | 1 231 374 A2 | 8/2002 |
| WO | 97/48896 A1 | 12/1997 |

*Primary Examiner* — Lindsay Low
*Assistant Examiner* — Ruben Picon-Feliciano
(74) *Attorney, Agent, or Firm* — Collard & Roe, P.C.

(57) ABSTRACT

A piston for an internal combustion engine is formed from an upper part connected to a lower part. The upper part has a combustion bowl, a top land, and a ring belt extending circumferentially around the piston upper part. The lower part contains pin bosses and a piston skirt. A circumferential cooling channel is formed by joining the upper and lower parts. There is an oil inlet formed in one piece with the piston lower part. The inlet has a lower extremity and an upper extremity that terminates at the floor of the cooling channel. A bore extends through the oil inlet from the lower extremity up though the floor of the cooling channel. The circumference of the bore increases from the upper extremity to the lower extremity, so the oil inlet forms a funnel shape.

11 Claims, 4 Drawing Sheets

(56) References Cited

U.S. PATENT DOCUMENTS

| | | | | |
|---|---|---|---|---|
| 2005/0115523 | A1* | 6/2005 | Bauer | F02F 3/22 123/41.35 |
| 2007/0039460 | A1 | 2/2007 | Scharp | |
| 2009/0025550 | A1* | 1/2009 | Benz | B22C 9/105 92/186 |
| 2011/0185992 | A1 | 8/2011 | Gniesmer | |
| 2014/0130767 | A1* | 5/2014 | Leitl | F02F 3/22 123/193.6 |

* cited by examiner

PISTON FOR AN INTERNAL COMBUSTION ENGINE

BACKGROUND OF THE INVENTION

1. Field of the Invention

The present invention relates to a piston for an internal combustion engine, having a lower part and an upper part that are welded together to create a one-piece piston. The lower part has at least a piston skirt, and the upper part has at least a piston crown, a circumferential top land, and a circumferential ring belt provided with ring grooves. The lower and upper parts are welded together and form a circumferential, closed cooling channel between them. A funnel-shaped oil inlet is forged into the lower part to allow for oil to be sprayed into the cooling channel in an efficient manner.

2. The Prior Art

In pistons with closed cooling channels, it is necessary to provide an inlet through which cooling oil is sprayed. This inlet is usually provided through the floor of the cooling channel and communicates with the underside of the piston in the area just outside the pin boss. Oil is sprayed in via a nozzle through this inlet to cool the piston during operation. The spray angle is of great consideration, as better cooling is achieved with a wider angle as the oil enters the cooling channel.

There have been several attempts to construct an oil inlet that maximizes the cooling efficiency of the oil. For example, U.S. Pat. No. 5,730,090 to Kling et al. discloses a piston having an oblong oil inlet and a curved skirt wall that helps direct the oil spray to enter the inlet. U.S. Pat. No. 7,051,684 to Bauer shows a piston having an insert in the cooing channel cover. The insert is shaped so as to be wider on the bottom so it can concentrate the oil entering the cooling channel, and is shaped to distribute the oil efficiently throughout the channel.

WO97/48896 to Nardi discloses a piston having an oil inlet that is wider at the bottom than at the entrance to the cooling channel. The walls of the oil inlet are tapered to deflect the oil to the inside of the cooling channel. The oil inlet is formed as a channel through the piston base portion. While this solution can be effective, the resulting piston suffers from excess weight, as the material required to create the elongated oil inlet extends entirely around the circumference of the piston.

SUMMARY OF THE INVENTION

It is therefore an object of the present invention to provide a piston for an internal combustion engine having a closed cooling channel and a funnel shaped oil inlet that is forged into the piston base body, without adding significantly to the weight of the piston.

This object is accomplished by a piston for an internal combustion engine, that is formed from an upper part connected to a lower part. The upper part has a piston crown, a combustion bowl, and a ring belt extending circumferentially around the piston upper part. The lower part contains pin bosses and a piston skirt. A circumferential cooling channel is formed by joining the upper part and lower part and has a floor formed by the lower part. Each of the upper and lower parts has inner and outer circumferential walls that terminate in joining surfaces. The joining surface of the outer circumferential wall of the upper part is joined to the joining surface of the outer circumferential wall of the lower part, and the joining surfaces of the inner circumferential walls of the upper and lower parts are also joined by brazing or welding, and one such example would include friction welding. The closed cooling channel is thus formed between the joined inner and outer circumferential walls.

There is at least one oil inlet formed in one piece with the piston lower part, preferably by forging. The inlet has a lower extremity and an upper extremity that terminates at the floor of the cooling channel. A bore extends through the oil inlet from the lower extremity up though the floor of the cooling channel. The circumference of the bore decreases from the lower extremity to the upper extremity, so the oil inlet forms a funnel shape. The oil inlet is formed on one side by an interior wall of the piston skirt, and on an opposite side by a circumferential collar connected to the piston skirt.

In one embodiment, the oil inlet is located adjacent one of the pin bosses, and the collar is connected one end to the piston skirt and on another end to an interior wall of the respective pin boss.

The funnel shape of the oil inlet maximizes the amount of cooling oil that can enter the cooling channel, as the oil that is sprayed into the inlet is deflected off of the slanted walls and can enter the cooling channel at various angles. For best results, the ratio of the area of the bore at the upper extremity to the area of the bore at the lower extremity is in the range of 1:2 to 1:8.

The bore can be non-circular, i.e., oblong, at the lower extremity and circular or non-circular at the upper extremity. The oblong shape at the lower extremity allows for the use of a split oil jet that emits a non-circular spray. Aligning the jet with the shape of the lower extremity causes the oil inlet to collect the maximum amount of oil possible and feed it to the cooling channel, without excessive splash back.

In one embodiment, the area of the inner wall of the piston skirt that forms the oil inlet has an axial groove therein, which defines one of the sides of the bore.

The collar and thus the oil inlet itself preferably has an axial height of between 5 and 12 mm. But it is appreciated the height of the collar is related to the size of the piston and the available clearance between the piston and the connecting rod. In some forms, the collar height may exceed 20 mm to further increase the collection of oil into and through the cooling channel. The collar has an interior wall and an exterior wall joined by a curved bottom. The curved bottom preferably has a radius of curvature of 4-15 mm. In a preferred embodiment, there are two oil inlets, disposed approximately 180° from each other. In this case, one of the inlets is used as an oil outlet, to allow the oil to drain back out of the cooling channel.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
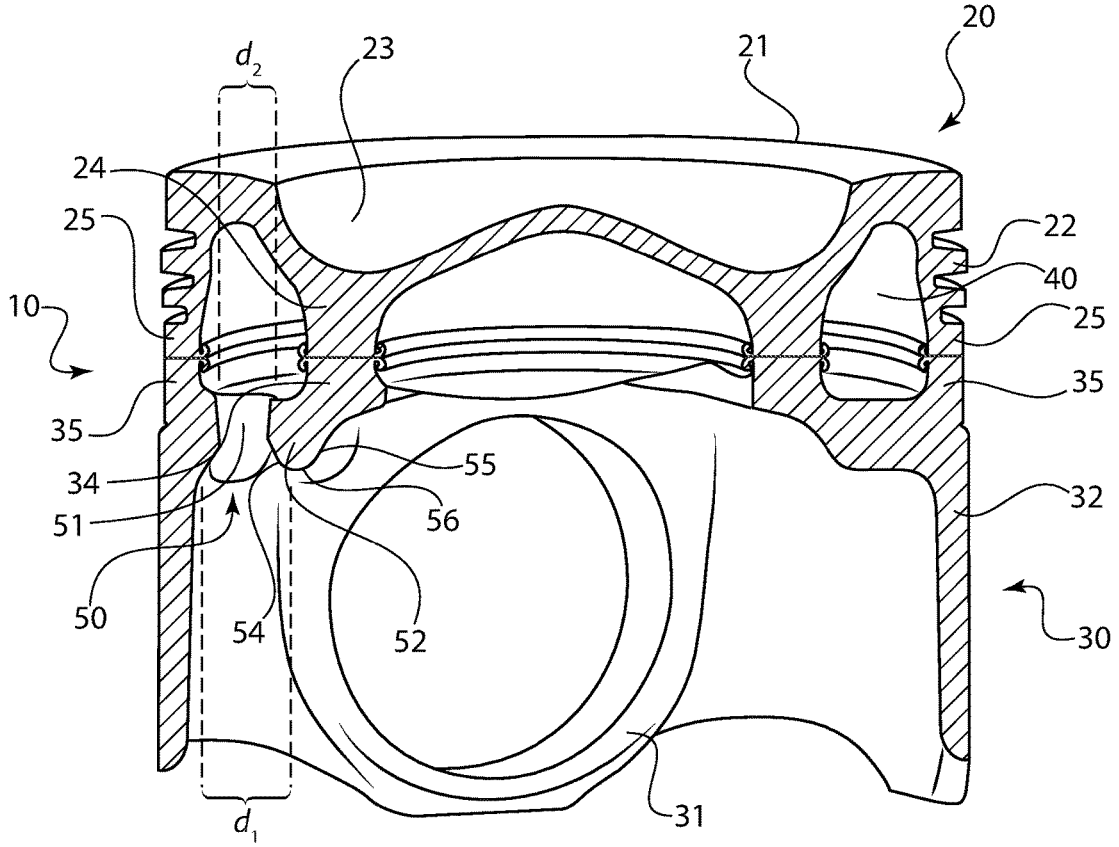
FIG. 1 shows a cross-sectional view of the piston according to the invention.
Figure 2:
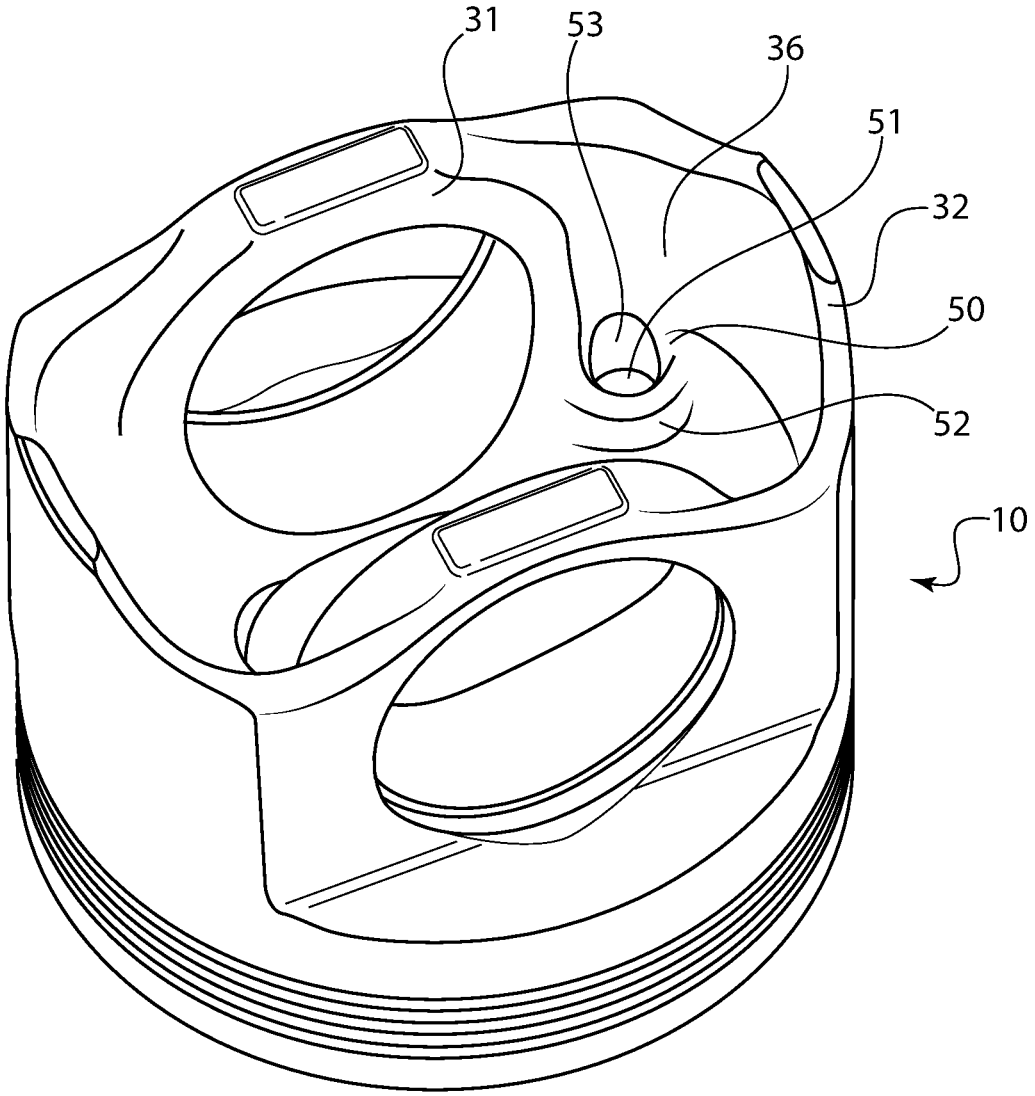
FIG. 2 shows a side and bottom view of the piston.
Figure 3:
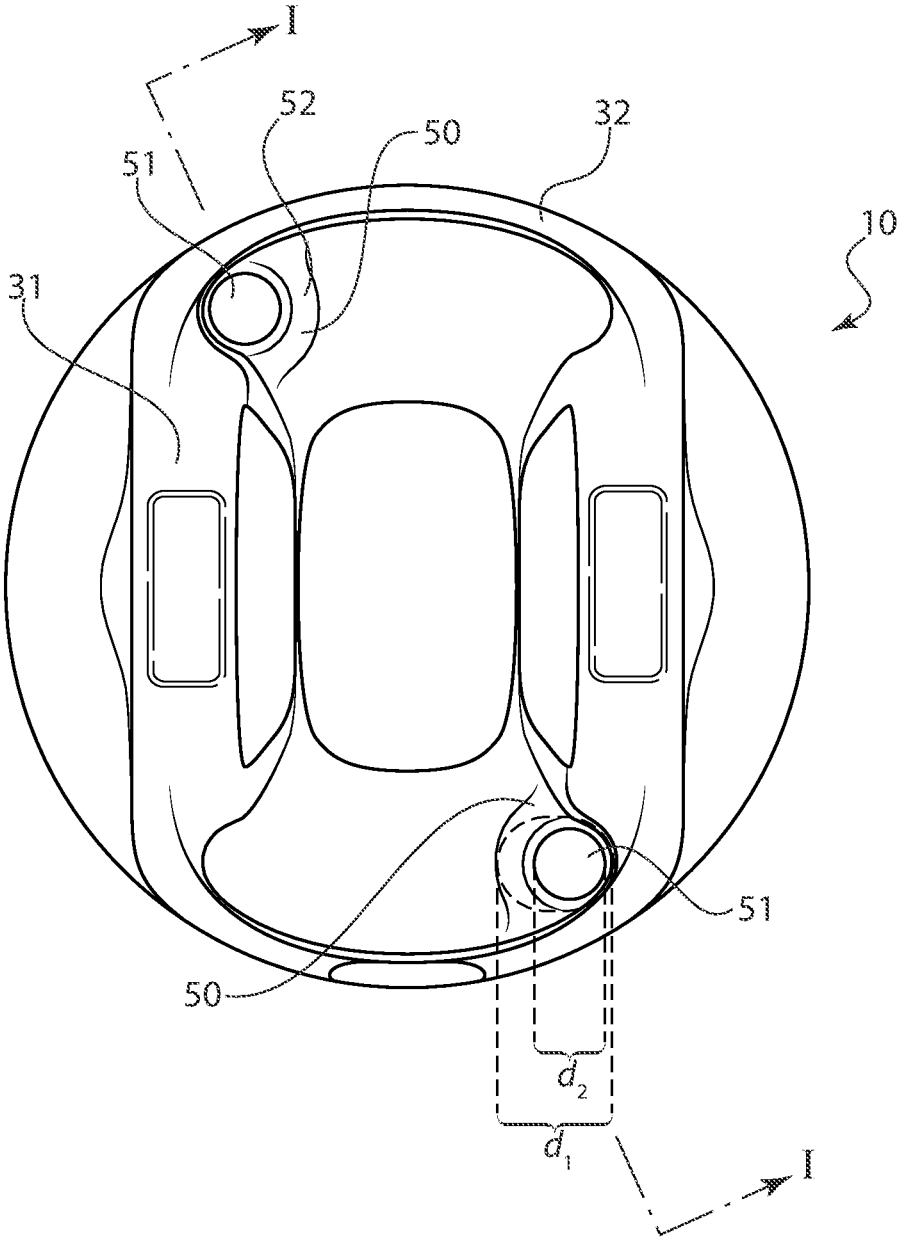
FIG. 3 shows a bottom view of the piston.

Referring now in detail to the drawings and, in particular, FIGS. 1-3 shows a a piston 10 according to the invention, with the cross-sectional view of FIG. 1 taken along lines I-I of FIG. 3. Piston 10 is formed from an upper part 20 having a piston crown 21, a ring belt 22 and a combustion bowl 23. Lower part 30 is comprised of two pin bosses 31 and a skirt 32. A closed cooling channel 40 is formed between upper part 10 and lower part 20, by joining inner and outer circumferential walls 24, 25, of upper part 20, with inner and outer circumferential walls 34, 35 of lower part 30, by brazing or welding, to enclose cooling channel 40.

To allow cooling oil to enter cooling channel 40, at least one oil inlet 50 is provided, which penetrates through a floor of cooling channel 40. Oil inlet 50 has a bore 51 surrounded by a collar 52 that extends between skirt 32 and pin boss 31. Collar 52 is forged in one piece with lower part 30. Bore 51 extends into the inner wall of skirt 32 in area 53. Collar 52 and inner skirt wall 36 form oil inlet 50, which has a funnel shape, as shown in FIG. 1. Bore 51 in the lower extremity of inlet 50 has a larger diameter $d_1$ than the diameter $d_2$ in the upper extremity that extends into cooling channel 40. For example, $d_1$ can be 16 mm and $d_2$ is preferably between 20 mm and 45 mm. In particular, bore 51 in the lower extremity of oil inlet 50 has an area that is between 2 and 8 times the area of bore 51 in the upper extremity at the floor of cooling channel 40.

Collar 52 has an interior wall 54 and an exterior wall 55 joined by a curved bottom 56. Curved bottom 56 preferably has a radius of curvature of 4-15 mm. Interior wall 54 is slanted so as to create the funnel shape of oil inlet 50.

Figure 4:
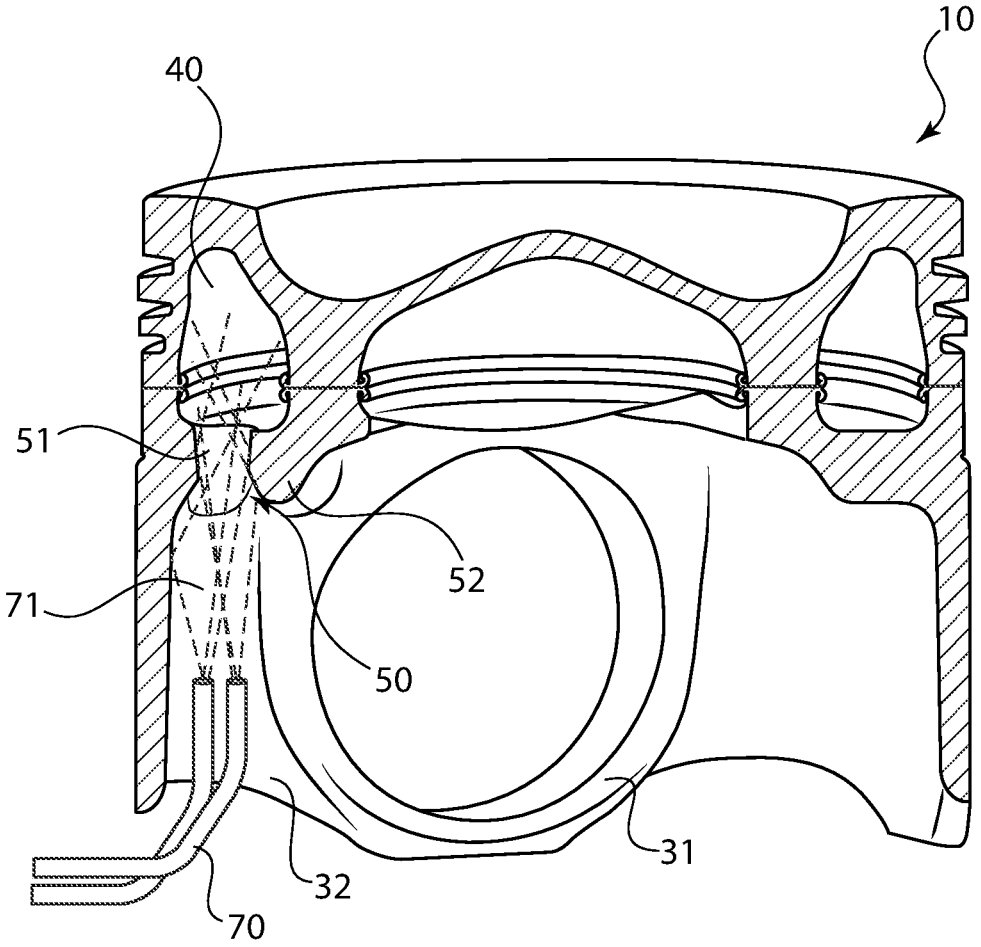
FIG. 4 shows the oil spray pattern through the oil inlet in a cross-sectional view.

As shown in FIG. 3, there can be two oil inlets 50 located on opposite sides of piston 10. Bore 51 in each inlet 50 has an oblong shape 60 with diameter $d_2$ at the lower end of inlet 50. This shape is beneficial when using a split oil nozzle 70 as shown in FIG. 4, as the oblong shape of the spray 71 exiting the nozzle 70 is captured fully by bore 51, and is directed through bore 51 into cooling channel 40 with minimal splash back.

By configuring the oil inlet 50 via collar 52, very little additional material is required to configure the funnel-shaped oil inlet. This minimizes the weight of the piston, leading to enhanced performance. Configuring oil inlet 50 as an oblong inlet in the bottom portion maximizes oil capture, especially when using a split oil nozzle. In addition, the forging of the funnel-shaped oil inlet reduces the secondary operations typically required to create a funnel around the inlet bore. For example, the forged inlet may reduce or eliminate the insert along with a press-fit or threading operation to secure the insert into the bore, reducing the manufacturing cost of the piston.

Accordingly, while only a few embodiments of the present invention have been shown and described, it is obvious that many changes and modifications may be made thereunto without departing from the spirit and scope of the invention.

What is claimed is:

1. A piston for an internal combustion engine, comprising:

an upper part having a combustion bowl, a top land, and a ring belt extending circumferentially around the piston upper part, a lower part connected to the upper part, the lower part having pin bosses and a piston skirt;

a circumferential cooling channel formed by the upper part and lower part and having a floor formed by the lower part; and at least one oil inlet formed in one piece with the piston lower part, and which is not a separate part that is inserted into the piston lower part, the at least one oil inlet having a lower extremity and an upper extremity, the upper extremity terminating at the floor of the cooling channel, the oil inlet having a bore extending from the lower extremity though the floor of the cooling channel, wherein a circumference of the bore increases from the upper extremity to the lower extremity, wherein the oil inlet is defined on one side by an interior wall of the piston skirt, and on an opposite side by a circumferential collar connected to the piston skirt and extending from an underside of the piston lower part in between interior faces of the pin bosses.

2. The piston according to claim 1, wherein the collar is connected one end to the piston skirt and on another end to an interior wall of one of the pin bosses.

3. The piston according to claim 1, wherein the ratio of an area of the bore at the upper extremity to the area of the bore at the lower extremity is in the range of 1:2 to 1:8.

4. The piston according to claim 1, wherein the bore is non-circular at the lower extremity.

5. The piston according to claim 1, wherein the area of the inner wall of the piston skirt that forms the oil inlet has an axial groove therein, said groove defining a side of the bore.

6. The piston according to claim 1, wherein the oil inlet is made by forging.

7. The piston according to claim 1, wherein the collar has an axial height of between 5-12 mm.

8. The piston according to claim 1, wherein the collar has an interior wall and an exterior wall joined by a curved bottom.

9. The piston according to claim 8, wherein the curved bottom has a radius of curvature of 4-15 mm.

10. The piston according to claim 1, wherein the upper part is welded to the lower part.

11. The piston according to claim 1, wherein there are two oil inlets, disposed approximately 180° from each other.

* * * * *